US008419607B2

(12) United States Patent
Mackel et al.

(10) Patent No.: US 8,419,607 B2
(45) Date of Patent: Apr. 16, 2013

(54) CENTRIFUGE INCLUDING A DRUM AND SOLID DISCHARGE ORIFICES HAVING BORES ARRANGED AT SELECTED VERTICAL HEIGHTS ALONG AN EXTERIOR OF THE DRUM

(75) Inventors: Wilfried Mackel, Lippetal (DE); Andreas Penkl, Lippetal (DE); Thomas Bathelt, Oelde (DE); Kathrin Quiter, Drensteinfurt (DE); Klaus Baalmann, Greven (DE)

(73) Assignee: Westfalia Separator AG, Oelde (DE)

( * ) Notice: Subject to any disclaimer, the term of this patent is extended or adjusted under 35 U.S.C. 154(b) by 837 days.

(21) Appl. No.: 12/514,690

(22) PCT Filed: Nov. 8, 2007

(86) PCT No.: PCT/EP2007/062029

§ 371 (c)(1),
(2), (4) Date: Aug. 31, 2009

(87) PCT Pub. No.: WO2008/058883

PCT Pub. Date: May 22, 2008

(65) Prior Publication Data

US 2010/0062923 A1 Mar. 11, 2010

(30) Foreign Application Priority Data

Nov. 14, 2006 (DE) ..... 10 2006 053 491

(51) Int. Cl.
*B04B 1/10* (2006.01)

(52) U.S. Cl.
USPC ..... 494/56

(58) Field of Classification Search ..... 494/2–4, 494/45, 56, 80, 81, 30, 63, 67–73
See application file for complete search history.

(56) References Cited

U.S. PATENT DOCUMENTS

| | | | | |
|---|---|---|---|---|
| 3,823,869 | A * | 7/1974 | Loison | 494/56 |
| 4,966,576 | A | 10/1990 | Schulz et al. | |
| 5,338,284 | A * | 8/1994 | Knelson | 494/28 |
| 5,462,513 | A * | 10/1995 | McAlister | 494/56 |
| 5,586,965 | A * | 12/1996 | Knelson | 494/29 |
| 5,601,523 | A * | 2/1997 | Knelson | 494/29 |
| 5,601,524 | A * | 2/1997 | Knelson | 494/29 |
| 6,149,572 | A * | 11/2000 | Knelson | 494/37 |

(Continued)

FOREIGN PATENT DOCUMENTS

| | | |
|---|---|---|
| DE | 36 19 298 C1 | 8/1987 |
| DE | 202 19 551 U1 | 6/2004 |

OTHER PUBLICATIONS

Notification Concerning Transmittal of International Preliminary Report, and Notification of Transmittal of Translation of the International Preliminary Report on Patentability of PCT/EP2007/062029, dated Nov. 8, 2007.

*Primary Examiner* — Charles E Cooley
(74) *Attorney, Agent, or Firm* — Barnes & Thornburg LLP

(57) ABSTRACT

A centrifuge includes a centrifugal drum rotatable about a vertical axis of rotation. The centrifugal drum includes one or more solids discharge orifices located at an area of the largest inside diameter of the drum. The solids discharge orifices include bores having discharge openings. The bores are arranged at least partially on an exterior of the centrifugal drum in a vertical direction Z at selected vertical heights along the exterior of the centrifugal drum.

13 Claims, 5 Drawing Sheets

U.S. PATENT DOCUMENTS 6,796,934 B1 * 9/2004 McAlister et al. ..... 494/56
6,962,560 B2 * 11/2005 Grewal ..... 494/29
2006/0166803 A1 7/2006 Schulz et al.
2010/0062923 A1 * 3/2010 Mackel et al. ..... 494/56

* cited by examiner

CENTRIFUGE INCLUDING A DRUM AND SOLID DISCHARGE ORIFICES HAVING BORES ARRANGED AT SELECTED VERTICAL HEIGHTS ALONG AN EXTERIOR OF THE DRUM

CROSS-REFERENCE TO RELATED APPLICATIONS

This application is a National Phase Application based upon and claiming the benefit of priority to PCT/EP2007/062029, filed on Nov. 8, 2007, which is based upon and claims the benefit of priority to German Patent Application No. DE 10 2006 053 491.3 400.3, filed on Nov. 14, 2006, the contents of both of which are incorporated herein by reference.

BACKGROUND AND SUMMARY

The present disclosure relates to a centrifuge having a centrifugal drum rotatable about an axis of rotation. The centrifuge may be a separator having a centrifugal drum rotatable about a vertical axis of rotation. The rotatable drum may have a single cone or biconical construction in an interior. The drum is provided, in an area of its largest inside diameter, with at least one or more solids discharge orifices having bores with discharge openings.

A separator of this type is known from U.S. Patent Document U.S. Pat. No. 3,108,952. Solids discharge orifices are arranged in a mutually angularly offset manner in the exterior jacket of the centrifugal drum in the area of the largest inside diameter of the centrifugal drum. Orifice bodies are inserted into bores of the drum jacket. The orifice bodies do not extend radially to the outside but are oriented in an inclined fashion with respect to the respective radial direction in order to utilize the acceleration effect of the product phase exiting from the orifices. That reduces the energy required for rotating the centrifugal drum.

Since the discharge orifices are arranged inclined with respect to the radial direction, at least a certain portion of the product stream exiting from the discharge orifices may strike the exterior drum jacket or collide with this jacket. That may result in considerable wear of the exterior drum jacket.

As a result of erosion, grooves may form in the exterior drum jacket, which become deeper and longer over time and therefore limit the useful life of the drum.

U.S. Patent Document U.S. Pat. No. 2,695,748 shows a similar state of the art. The discharge orifices illustrated in that document consist of a first sleeve with a bore extending centrically through the sleeve from the interior radially to the outside. The first sleeves are inserted into the bores of the drum jacket. A second sleeve is screwed into them in their end region at an angle with respect to the radial direction. The second sleeve also has a centric bore, so that the product phase exiting from the centrifugal drum is first guided through the first sleeve radially to the outside and then through the second sleeve, from which it exits in an inclined manner with respect to the radial direction against the rotating direction of the separator.

From U.S. Pat. No. 2,695,748, it is also known to insert the first sleeve also at an angle with respect to the radial direction into a bore of the drum jacket. At its outer end, the sleeve closes off approximately flush with the exterior side of the centrifugal drum, which has the result that behind the discharge of the sleeve with the orifice, the product stream in a recess of the centrifugal drum can strike against the drum jacket and may erode it. A projection engaging in a groove of the centrifugal drum is used for fixing the first sleeve to the centrifugal drum.

A similar construction is shown in U.S. Patent Document U.S. Pat. No. 2,060,239.

For solving this problem, it was suggested in German Patent Document DE 202 19 551 to arrange at least one protection element against wear made of a hard metal on the drum jacket in the area of the solids discharge orifices, and/or to construct a coating of a ramp in the exterior drum jacket. These measures cause additional expenditures.

From Austrian Patent Document AT 9622 B, a centrifugal drum is known which, in the vertical direction, is divided several times by disks into individual centrifugal spaces of a respectively biconical contour. On the drum's largest inside diameter, discharge openings are constructed.

Concerning the state of the art, reference is also made to French Patent Document FR 1,598,924 A which shows a separator having a drum which, in sections, has several jackets.

In addition, German Patent Document DE 36 19 298 shows a disk separator having a biconical drum interior, on whose largest inside diameter solids discharge orifices are constructed. By way of tubes which, at an axially offset position of the drum situated "higher" in the vertical arrangement and radially farther inside, lead out of the drum. In addition, a product phase, which contains only a few solids, can be guided out of the drum from a radius situated farther in the interior. As a result, a product phase of a different nature is discharged through tubes than through the solids discharge orifices.

The present disclosure relates to, among other things, a centrifuge configured to prolong the service life of the drum by simple devices.

The present disclosure thus relates to a centrifuge including a centrifugal drum rotatable about a vertical axis of rotation. The centrifugal drum includes one or more solids discharge orifices located at an area of the largest inside diameter of the drum. The solids discharge orifices includes bores having discharge openings. The bores are arranged at least partially on an exterior of the centrifugal drum in a vertical direction Z at selected vertical heights along the exterior of the centrifugal drum.

Accordingly, the bores are completely or at least partly, arranged in the axial or vertical direction, at different heights along or relative to the Z-direction or Z-axis, in the solids discharge orifices. The bores are in the area of the largest inside diameter in the centrifugal drum, which drum is conical or biconical on the inside.

According to the present disclosure, it may be advantageous that recesses or indentations in a drum jacket which, related to the rotating direction of the drum, are situated behind the discharge orifices. The recesses or indentations may, as a result of the increasing wear when in use, become increasingly longer and can reach a much greater length in the circumferential direction before they reach the respectively next discharge orifice in the circumferential direction. This is compared to the situation when all of the discharge openings are situated at only one vertical height along or relative to the Z-axis, which is parallel to the axis of rotation.

According to the present disclosure, an effective protection against wear of the separator drum is implemented in a simple manner such that the service life of the drum or the part of the drum which has the discharge openings can be increased. That part is usually the bottom part of the drum.

It may be advantageous that, as desired, the measure for the protection against wear can also be combined with additional measures for the protection against wear, such as coatings or elements in the area of the discharge openings.

The structure of the centrifuge of the present disclosure is suitable for separators whose centrifugal drums have a vertical axis of rotation and which, on the inside and/or outside, have a single-cone or biconical construction. The solids discharge orifices having orifice bodies which are arranged in the area of the largest diameter of the centrifugal drum or may be inserted into the drum from the outside.

The centrifuge according to the present disclosure may be used in the case of separators whose discharge openings are arranged to be offset toward the inside by a distance relative to the largest outer circumference or outside diameter of the centrifugal drum. The discharge openings may each have a groove-type indentation or recess as an extension of the discharge openings in the drum jacket which, as a rule, have a wedge-shaped further development, so that the solids can exit at a flat angle which, if possible, approximates a tangent.

The discharge openings are situated in the circumferential direction alternately in two mutually parallel planes which are oriented perpendicular to the vertical, or the Z-axis. In the circumferential direction, the discharge openings are arranged alternately in the first plane and in the second plane, which results in an effective protection against wear.

In an embodiment of the present disclosure, the position and orientation of the actual bores remain unchanged, and only the respective orifice bodies are oriented slightly differently. That is so that their discharge openings are situated completely at different planes perpendicular to the vertical line.

Such an embodiment has an advantage that neither the bores nor the orifice bodies have to be changed in comparison to known constructions. It is only necessary to orient the orifice bodies in a different manner.

An analogous effect could be achieved, according to the present disclosure, by the use of different orifice bodies which are provided with differently oriented bores but are mounted in an identical fashion.

According to another embodiment of the present disclosure, the inlet openings and also the interior mouths of the openings are situated at a common vertical height. As a result, and advantageously, at least the contour of the drum interior does not have to be changed.

In contrast, the bores themselves have a different orientation, for example, in the circumferential direction, alternately diagonally upward and diagonally downward relative to the Z-axis. Thus, at least the discharge openings of the orifice bodies screwed into the bores are situated at a different vertical height.

A greater vertical offset of the area of the discharge opening can also be achieved by the sole measure of the different orientation of the orifice bodies in the openings. Naturally, these two measures can also be combined so that, if necessary, they complement one another in accordance with the present disclosure.

It is advantageous for the discharge openings to lead to the outside in an annular area of the drum in which the drum jacket has a constant diameter.

According to another embodiment of the present disclosure, the bores are situated completely, in the area of their interior inlet opening, at a different vertical height. This has an advantage but requires a new contouring of the interior drum jacket, as shown, for example, in FIG. 2.

It is within the scope of the present disclosure to arrange the openings in the circumferential direction in three or more different planes.

Other aspects of the present disclosure will become apparent from the following descriptions when considered in conjunction with the accompanying drawings.

DETAILED DESCRIPTION

Figure 1:
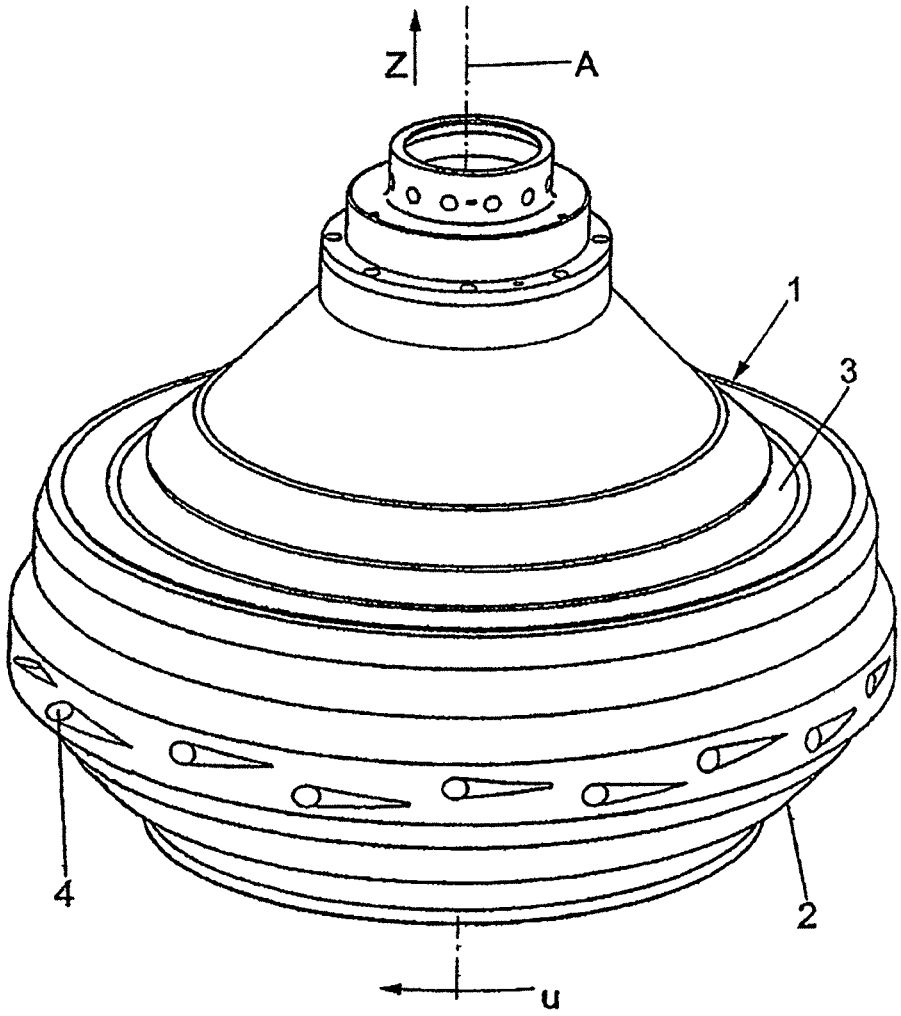
FIG. 1 is a perspective view of a separator drum, according to the present disclosure.

FIG. 1 is a perspective view of a separator drum 1 with a vertical axis of rotation A. A vertical height at or along the drum 1 is labeled "Z" for Z-axis, as shown in FIGS. 1 and 2*b*. The rotating direction of the drum 1 is marked by the arrow U.

The separator drum 1 has a drum bottom part 2 and a drum top part 3 which form an exterior drum jacket of, for example, biconical geometry. Embodiments with single-cone drums or non-conical drums are also within the scope of the present disclosure. In addition, the drums may have a single-cone or biconical construction with respect to their interior.

A separating disk stack having separating disks may be inserted into the separator drum 1 (not shown).

The separator drum 1 also has an inlet pipe (not shown) and liquid outlets (not shown). The separator drum 1 may be constructed as a two-phase machine, for example, a solids phase and a liquid phase or as a three-phase machine, for example, a solids phase and two liquid phases. Furthermore, the separator drum 1 may be continuously operated and may continuously discharge the solids phase.

The separator drum 1, and more particularly, the drum bottom part 2, is provided with several discharge orifices. For this purpose, at least two, and possibly several openings, such as bores 4, penetrate the separator drum 1. These bores 4 are formed in the area of the largest diameter, as shown in FIG. 2*a*, of the drum 1 and penetrate the drum jacket from the drum interior to the outside. A sleeve-type orifice body 5 is inserted, for example, screwed, into each of the bores 4, as shown, for example, in FIGS. 2*a* and 4. This permits the solids to be discharged from the drum interior.

As suggested in FIG. 2*a*, the drum bottom part 2 has a recess 6, for example, in the area in which it is penetrated by the bores or openings 4, and located radially in front of each bore or opening 4. Recess 6 tapers toward the outside in the direction of the openings 4. As a result, the buildup of solids or solid sediments between the orifice bodies 5 is minimized.

The orifice bodies 5 are provided with a bore 7 extending from the drum interior in the direction of the drum exterior. Bore 7 extends in a first bore section 8 at first essentially in the radial direction from the inside to the outside and then changes into a bore section 9 oriented at an angle with respect to the first bore section 9, as shown, for example, in FIG. 4.

A discharge opening 10 of the bore section 9 is oriented at an angle with respect to the radial direction R such that an angle $\alpha$ between the radial direction and the discharge opening 10 or the second bore area 9 is equal to or smaller than 90°. Angle $\alpha$ may be between 45° and 90°.

Since the orifice bodies 5 on the outside close off essentially flush with the outer edge of the drum jacket or exterior of the separator drum 1, the discharge opening 10 is offset toward the interior relative to the largest outer circumference or diameter of the centrifugal drum 1 or of the drum jacket.

Correspondingly, groove-type indentations or recesses 11 are formed at an angle with respect to the radial direction as an extension of the second bore section 9. Those recesses 11 may already be constructed in the drum jacket, so that the product phase exiting from the discharge orifices, if possible, will spray past the drum jacket on the outside.

Figure 3:
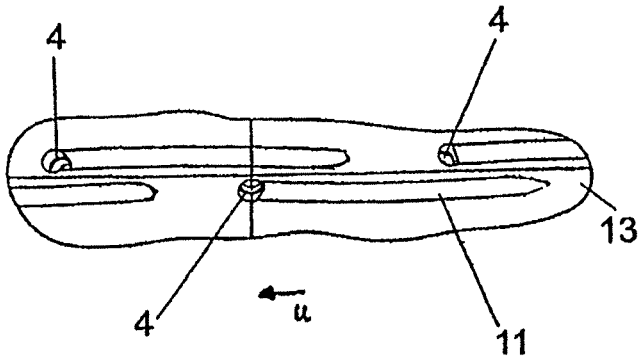
FIG. 3 shows outlines of wear at the drum bottom part from FIG. 2.
Figure 4:
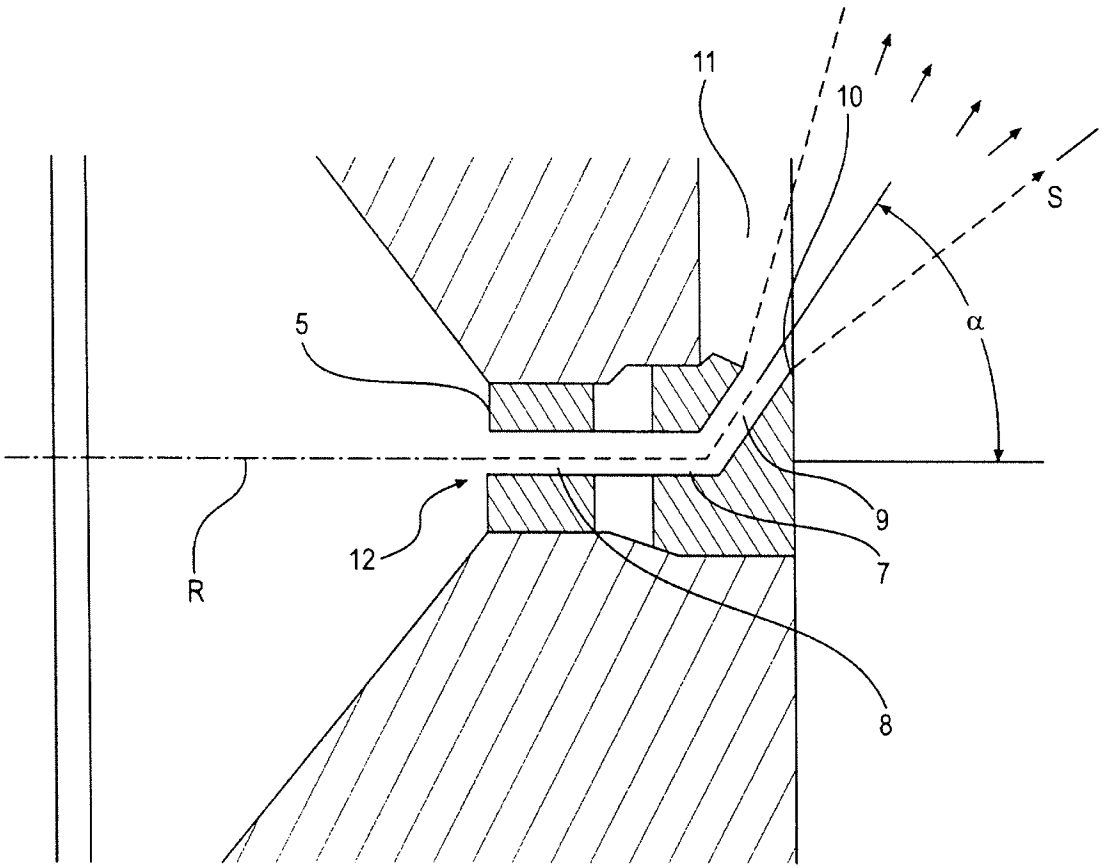
FIG. 4 is a view of an enlargement of a cutout of an area of FIG. 2*a*.

However, in such a construction, a portion of solids S, as shown in FIG. 4 exiting from the discharge openings 10 will strike the drum jacket again and could, depending on the product to be processed, cause an erosion of the drum jacket. That could be in the exterior area of the groove-type indentation or recess 11 as well as also farther in the circumferential direction. Because of this erosion, the groove-type indentation 11 may possibly lengthen over time, as suggested in a comparison of FIGS. 2 and 3.

It is provided that the bores 7 of the orifice bodies 5, and possibly the bores 4 in the drum jacket which receive the orifice bodies 5, are situated completely, or at least in the area of their discharge openings 10, in the vertical direction not in one plane but in at least two or more mutually different planes E1, E2.

Thus, at least the discharge openings 10 are situated in two mutually parallel planes E1, E2 which are oriented perpendicular with respect to the vertical or the Z-axis. As a result, they are arranged in the circumferential direction alternately in the first plane E1 and in the second plane E2. This is shown in FIG. 2*d*.

Figure 5:
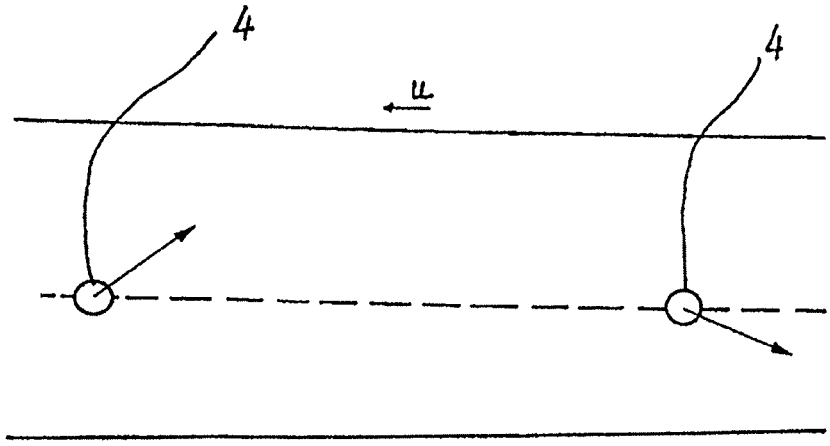
FIG. 5 shows another embodiment of orifices of a centrifuge, according to the present disclosure, with solids being emitted in different directions.

FIG. 5 illustrates another embodiment, according to the present disclosure, where the discharge openings 10 associated with bores 4 are situated in one plane. The bores 4 or areas in front of the discharge openings 10 are oriented such that the solids are emitted in different directions diagonally upward and downward, so that the service life is also prolonged.

Inlet openings 12 of the bores 7 are shown in FIG. 4. The bores 4, in contrast, are situated in a common plane with respect to the drum axis as shown, for example, in FIG. 5, so that the contour of the interior jacket of the separator drum 1 does not have to be changed by the measure of arranging the discharge openings 10 in at least two or more different planes.

This results in the advantage that the recesses 11 behind discharge orifices or openings 10, which become increasingly long as a result of wear when in use, may reach a much greater length in the circumferential direction, against the rotating direction (see FIG. 3), before they reach the respectively next discharge orifice 10, shown as bores 4, in the circumferential direction, than if all the discharge orifices 10 were situated in only one plane.

Other embodiments are conceivable within the scope of the present disclosure.

In one such an embodiment, the position and orientation of the bores 4 are left unchanged and only the orifice bodies 5 are oriented in a slightly different manner, so that their discharge orifices 10 will be situated in different planes with respect to the vertical line or Z-axis.

According to the embodiment of FIGS. 1 to 4, the inlet openings 12 or the interior mouths of the openings or bores 4 are situated at a vertical height Z. Then, advantageously, at least the contour of the drum interior does not have to be changed.

In contrast, the bores 4 are oriented differently, for example, in the circumferential direction, alternately diagonally upward and diagonally downward relative to an interior mouth. At least the discharge openings 10 of the orifice bodies 5 screwed into the bores 4 are situated at a different vertical height. For example, see planes E1, E2 in FIG. 2.

Figure 2:
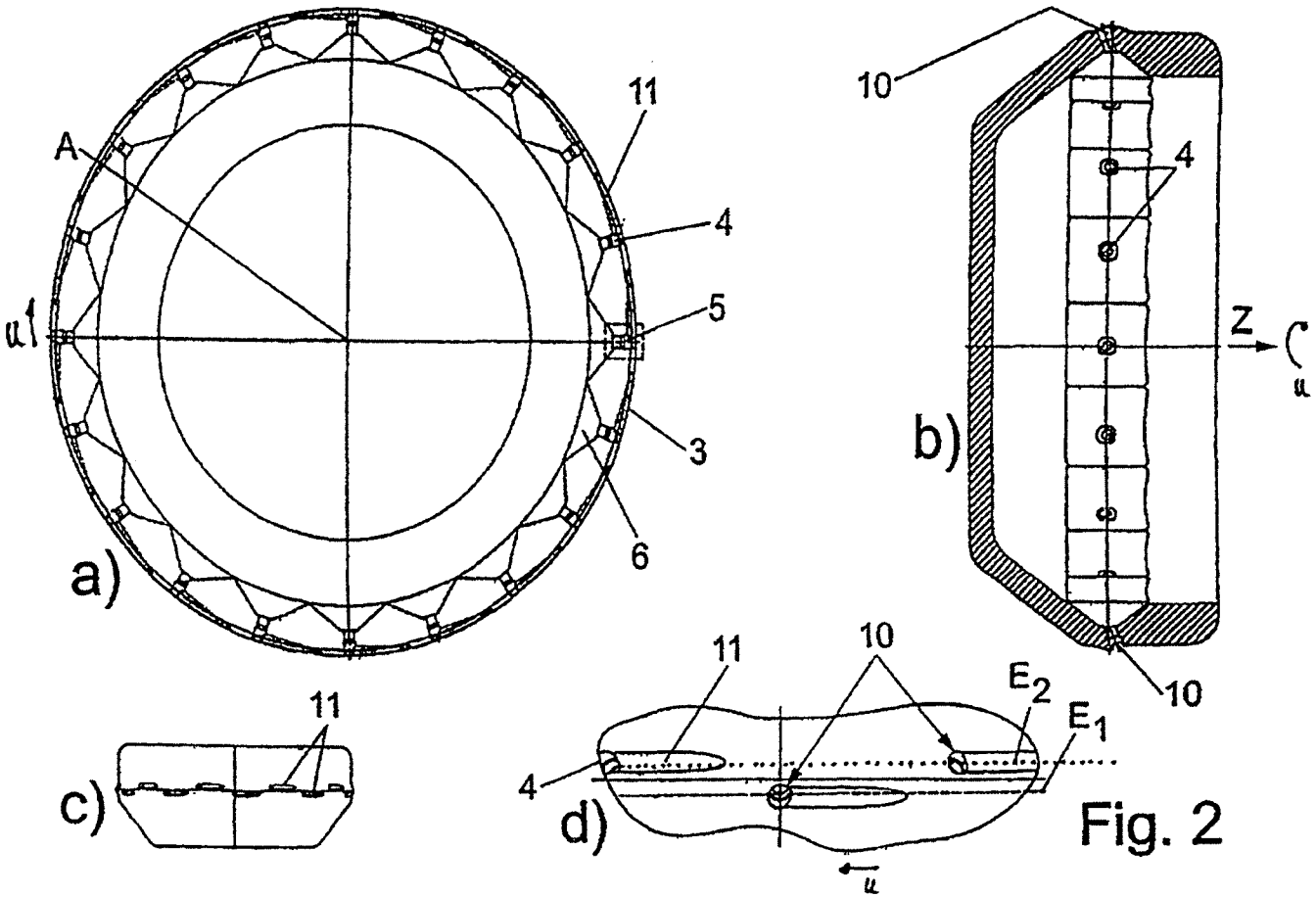
FIGS. 2*a-d* show different areas of a drum bottom part of the drum of FIG. 1.

Such an embodiment is illustrated in FIGS. 2 and 3, among others. In this fashion, a greater vertical offset of the area of the discharge opening 10 is achieved than would be achieved as a result of the sole measure of the different orientation of the orifice body 5 in the openings or bores 4. However, these two measures can naturally be combined, so that, as required, they complement one another, in accordance with the present disclosure.

It is advantageous for the discharge openings 10 to lead to the outside in an annular area 13 of the drum 1 in which the drum jacket has a completely or essentially constant diameter.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A centrifuge comprising:

a centrifugal drum rotatable about a vertical axis of rotation, the centrifugal drum including one or more solids discharge orifices located at an area of the largest inside diameter of the drum, the solids discharge orifices including bores having discharge openings, and wherein the bores are arranged at least partially on an exterior of the centrifugal drum in a vertical direction Z at selected vertical heights along the exterior of the centrifugal drum;

wherein the solids discharge orifices include orifice bodies which are inserted into the discharge orifices in a drum jacket and extend through the drum jacket from an inside to an outside of the centrifugal drum, and the orifice bodies are each configured with the bores extending from an interior of the drum in the direction of the exterior of the drum; and wherein the orifice bodies include a first bore section and the bores first extend essentially in a radial direction from the inside to the outside of the centrifugal drum, and then the first bore section changes to a second bore section oriented at an angle with respect to the first bore section, and the discharge openings located in the second bore section are each aligned at an angle with respect to the radial direction.

2. The centrifuge according to claim 1, wherein the bores are arranged at least in the area of their respective discharge openings.

3. The centrifuge according to claim 1, wherein the bores are oriented and aligned such that a solids phase exits from the discharge openings at least in two different directions.

4. The centrifuge according to claim 1, wherein the discharge openings are situated in at least two mutually different planes which are aligned perpendicularly with respect to the axis of rotation of the drum.

5. The centrifuge according to claim 1, wherein the discharge openings are situated in the circumferential direction alternately in two mutually different planes which are oriented perpendicular to the axis of rotation of the drum.

6. The centrifuge according to claim 1, wherein the solids discharge orifices include orifice bodies which are arranged in the area of the largest inside diameter of the centrifugal drum.

7. The centrifuge according to claim 1, wherein the orifice bodies are each inserted differently into the discharge orifices in such a manner that their respective discharge openings lead out in different vertical planes.

8. The centrifuge according to claim 1, wherein the discharge openings are each offset toward the inside relative to the largest inside diameter of the centrifugal drum as a lengthening of the second bore section, and a recess is constructed in the drum jacket, which recess is formed at an angle with respect to the radial direction.

9. The centrifuge according to claim 1, wherein one of the solids discharge orifices and the bores include inlet openings which are situated in one of a common plane and at a vertical height relative to the vertical axis of rotation.

10. The centrifuge according to claim 1, wherein the bores of the orifice bodies are each constructed at a different vertical height.

11. The centrifuge according to claim 1, wherein the discharge openings are constructed in an annular area of a drum bottom part which drum bottom part has a constant diameter.

12. The centrifuge according to claim 1, wherein the centrifugal drum is constructed having one of a single-conical and a biconical interior.

13. A centrifuge comprising:

a centrifugal drum rotatable about a vertical axis of rotation, the centrifugal drum including one or more solids discharge orifices located at an area of the largest inside diameter of the drum, the solids discharge orifices including bores having discharge openings, and wherein the bores are arranged at least partially on an exterior of the centrifugal drum in a vertical direction Z at selected vertical heights along the exterior of the centrifugal drum; and wherein the discharge orifices are alternately oriented diagonally upward and diagonally downward relative to the exterior of the drum.

* * * * *